United States Patent [19]

Bianchini

[11] 4,000,589

[45] Jan. 4, 1977

[54] CONGRUENT MODULAR BUILDING SEGMENTS

[76] Inventor: Antonio Bianchini, 1821 Alexander Ave., Cheyenne, Wyo. 82001

[22] Filed: Feb. 13, 1976

[21] Appl. No.: 658,128

[52] U.S. Cl. ..... 52/79.5; 52/236.1; 52/236.3

[51] Int. Cl.[2] ..... E04B 1/348

[58] Field of Search ..... 52/79, 237, 236, DIG. 10

[56] References Cited

UNITED STATES PATENTS

| | | | |
|---|---|---|---|
| 2,698,973 | 1/1965 | Zeckendorf | 52/237 |
| 2,769,211 | 11/1956 | Hewitt | 52/79 |
| 3,257,154 | 6/1966 | Lewis | 52/79 |
| 3,358,407 | 12/1967 | Konig | 52/79 |
| 3,500,595 | 3/1970 | Bennett | 52/79 |
| 3,535,835 | 10/1970 | Küpper | 52/79 |
| 3,609,929 | 10/1971 | Brown | 52/79 |
| 3,696,574 | 10/1972 | Deitrich | 52/79 |

*Primary Examiner*—Price C. Faw, Jr.
*Assistant Examiner*—Henry Raduazo

[57] ABSTRACT

A building formed by horizontally conjoining a plurality of congruent, self-supporting, sector-like modular building segments, each comprising a sector floor and congruent roof section, and a straight and opposing vee-shaped wall section, supported in between two opposite and converging identical rib-frames, each continuously structural and symmetrically equal about their respective planes of symmetry, therein allowing a plurality of modular building segments to interconnect on either rib-frame side to produce a variety of building configurations, one of which being a regular polygon-like building containing an interior open court. Mutually interconnected rib-frames of conjoining modular building segments, which are each approximately of bedroom-size area, fully open within their rectangular rib-frame perimeters for contiguous room expansion and for placement of various types of multifunctional demountable interior partitioning. Rib-frames structurally protrude continuously on the exterior to accommodate common foundation members, to provide multistory stacking alignment support, and for separation of independent floor and roof elements between all story-levels. Modular building segments, transportable in either their premanufactured, prefinished, portable component sections or in factory assembled modular units, will each mechanically connect and disconnect between the mutually interconnected rib-frames of all conjoining modular building segments and also between individually assembled floor, roof, wall, and rib-frame sections. Straight and vee-shaped wall sections contain one and two openings respectively to accommodate either door, window, or other detachable fascade panel elements of different function and design to optionally change a modular building segment's external character. A utilities trough accessible from the outside is established at each of the four modular building segment corners where floor and roof sections meet non-load bearing opposing wall sections.

5 Claims, 5 Drawing Figures

CONGRUENT MODULAR BUILDING SEGMENTS

BACKGROUND OF THE INVENTION

This invention is relative to buildings and more particularly to the construction of a building by conjoining individually premanufactured, congruent modular building segments, designed of a certain modular shape and structure, to allow a combination of such segments to be optionally arranged into myriad whole buildings of varying novel form and utility.

To free building, especially residential, from its critically entrenched state of "geometric rigidity," and therefore its consequent economic and subsequent aesthetic deficiency, it is necessary to comprehend building, not as a statically designed and analytically engineered site-shelter, but as a dynamically conceived, systemized building entity, which inventively synthesizes the critical building essentials of space, shape, and structure, into elements of construction highly capable of being industrially reproduced into congruent segments of the system; segments which possess the ability to construct into buildings of variable configuration by the nature of their flexible integration.

The state of the art, currently in a state of groping infancy, is heretofore based upon building geometry of static shape, structure, and, or space factors which intrinsically cannot be properly formulated to achieve, via the industrialization process, systemized buildings of multiple form and utility. Regretfully, the art is being predominantly practiced by transforming traditional "box-geometry," carried-over from antiquated site-constructin methods, to the factory arena, where artlessly it is expected to mass-produce into buildings of successful marketability, precluded by the sole consideration of the proven low unit-costs of industrialization. To date however, such rigid common as well as uncommon building geometry, whether utilized in a limited commercial practice or existing solely as state of the art literature, has not and inherently cannot achieve the degree of total success necessary to warrant the efforts of full building industrialization as opposed to conventional site-building with its varying incorporations of factory-made components.

For the art of building by industrialization to succeed to rightful expectation it must realize and resolve the diametric fundamentals of Building versus Industrialization; the latter, a machine condition demanding strict and total economic allegiance to product repetition; the former, a human condition demanding a shelter product of varietal expression, in form, space, and multiple-use capacity. The resolution of this diametric, once acknowledged, not only requires the awareness that static building geometry inherently cannot ever industrialize to meet the diverse form, functional, and aesthetic building needs of a dynamic society, but further, that the special geometry conceived must be capable of synthesizing into a particular building methodology consistent with the essentials peculiar to the unusual process of building industrialization. These essentials being, Factory Mass-Duplication and Site Mass Variation; Mass-Duplication, is the ability of a building methodology to possess the unique geometry of space, shape, and structure which enables whole buildings to be composed from as many exact duplicates of mass-produced segments as is minimally necessary to achieve industrial economy; Mass Variation, is the ability of a building methodology, through its unique geometry, to be optionally composed into a variety of plan, size, function, and form masses, by easily site-connecting building segments of modular congruency.

SUMMARY OF THE INVENTION

The idea of dynamic building by geometric variation on a single shape duplication theme of self-supporting, congruent modular building segments, optionally transportable in modular or sectional form, and structurally articulated to allow multifunctional plan compositions to be rhythmically arranged into single or multistory building complexes of diverse plan, form, size, and appearance, which harmoniously integrate with any type physical environment, is not only the nature of this particular invention, which so brilliantly distinguishes it from all prior art, but moreover is the tenet upon which this same invention succeeds by demonstration to contend; that for the art of building by industrialization to universally blossom to just expectation, this precept will have to be the applied constant in the overall design formula utilized to develop urgent new building methodologies which will systemize, as does this invention, to function integrally with the uniquely complex and independent parameters of Building, plus Industrialization, plus Socio-conditions.

To demonstrate the validity of this precept, a relevant building methodology has been herein developed by initially conceiving according to premise, a dynamic building geometry, which for this particular invention manifests itself geometrically by extracting from two concentric plane circles one of their equally divided sector areas, and then developing this resulting sector shape into a systemized sector-like modular segment of a building, embodying in the main, a sector floor and congruent roof, a straight wall, and a vee-shaped opposing wall, supported in between by two opposite and identical converging rib-frames, which are each fully open within their continuously structural and symmetrical exterior protruding rectangular rib-frame perimeter. These individual building elements, sectionally designed to efficiently massproduce, are assembled at either factory or building site into a transportable, self-supporting modular building segment, which will interconnect with a congruent modular building segment equally on either one of each modular building segment's two identical rib-frame sides, to therein form, from a selected plurality of such horizontally conjoining congruent modular building segments, a complete building in one of the optional and myriad plans, forms, functions, and sizes, therein possible. A multistory building with independent and separate floor and roof elements spaced between story-levels is formed by stacking and supporting modular building segments between their vertically corresponding and structurally protruding rib-frames.

This exceptional building methodology, in being derived faithfully from the concepts originated herein, is technologically capable of progressively decreasing construction unit-costs, while simultaneously expanding unit-volume productivity. This rare economic building advantage is a result of this methodology's unique capacity to exploit the mass-production aspects of, first the "economics of industrial utilization," as effectively realized by this invention's common denominator of systemized parts, and second the "economics of sustained industrialization," as achieved by the natural ability of these same system parts to flexibly construct into building integers of such extraordinary variety, as to therein develop the necessary building markets broad enough to justify, feed, and sustain the relentless and natural industrial appetite for steady unit-productivity. By herein developing a building methodology that truly applies the foresaid essence of building industrialization economics, which the state of the art has heretofore unrealized, this singular building invention is capable of gaining the ultimate economics and profits of industrialization while providing society with environmental building of highest quality.

Accordingly, one object of this invention is to provide a building that embodies a plurality of congruent, self-supporting, premanufactured modular building segments, which optionally conjoin to produce a building in one of a myriad of optional plans, forms, functions, sizes, and types.

Another object of this invention is to provide a building which by optional juxtaposition of individual congruent modular building segments, will adjust to and accommodate any prospective building-site dimension, shape, and contour.

Still another object of this invention is to provide a building embodying a plurality of congruent, self-supporting modular building segments, which will erect at any elevation above ground level, and in multistories of diverse plan configuration, with each story-level having independent and separate floor and roof elements.

Yet another object of this invention is to provide a building which can have part or all of its form and appearance modified anytime prior to or after building occupancy, via rearrangement, removal, and addition of individual modular building segments, or by exchanging removable fascade panels for those of different design.

Also an object of this invention is to provide a building which can have either a room, part of a room, or any portion of the building, readily removed, rearranged, or added to, in order to expand, reduce, repair, modernize or functionally change a building in part or whole anytime during or after its completion, without requiring the usual construction delays and disruptions.

An additional object of this invention is to provide a building which fully utilizes the economics of mass-production by being constructed in multiples of congruent modular building segments, which further reduce into numerous components of greater redundancy and industrial efficiency.

Another object of this invention is to provide a building which is highly transportable, via road, rail, air, or sea, in either component sections or in lightweight, individual modular building segments.

A further object of this invention is to provide a building embodying congruent modular building segments, which are each specifically structured of elements and sections that efficiently and economically utilize any and all standard materials of construction, either singularly or in various combinations.

Still another object of this invention is to provide a building, embodying congruent modular building segments, which utilizes the dynamics of space, structure, form, and plan variation to achieve authentic building variety, instead of affecting this quality by plan-manipulating and fascade dressing a building of static geometry.

Yet another object of this invention is to provide a building embodying a plurality of congruent sector-like modular building segments which have entrance access on the two sector ends and which form a polygon-like building with a functional interior court.

An additional object of this invention is to provide a building in which modular building segments of room size expand into larger contiguous rooms of full wall width and ceiling height.

Also an object of this invention is to provide a building which has a utilities trough at top and bottom corners of each opposing wall, and is accessible from the outside.

One more object of this invention is to provide a quality building which is immediately accessible to virtually every income level through the purchase of as many nominally costing, individual modular building segments as is functionally appropriate and relative to one's present economic means, with the opportunity of expanding the building anytime thereafter by purchasing and easily interconnecting additional modular building segments according to one's future shelter needs and financial ability.

Other objects, features, and advantages of this invention, as well as additional characteristics of its singular uniqueness, will become further apparent by reading the accompanying drawings in conjunction with the Description Of The Preferred Embodiments.

DESCRIPTION OF THE PREFERRED EMBODIMENTS

Figure 1:
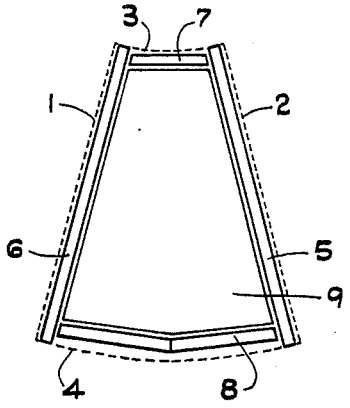
FIG. 1 is a plan view of the modular building segment, which is an embodiment of the invention.

The plan configuration FIG. 1 of this building invention is geometrically established by radially subdividing into equal 30° parts the plan area formed by two concentric circles. One of these equal parts, being a sector of the two circles and defined in perimeter by two equal length sector radii sides 1,2, and two unequal length sector arcs, 3,4, is thereupon translated, utilizing sectional building components, into a modular building segment, comprising, two identical rectangular rib-frames 5,6, which respectively are positioned parallel beside and within the sector's radii derived two side guidelines 1,2, terminating their respective ends at the sector's two arcs 3,4, to thereby establish the two rib-frames as converging and opposite one another; a straight wall section 7 is positioned longitudinally beside and within lesser arc guideline 3 between the two rib-frames 5,6 at their narrow converging end, and an opposing vee-shaped wall section 8 is positioned longitudinally beside and within greater arc guideline 4 between the two rib-frames 5,6 at their wide diverging end.

Figure 2:
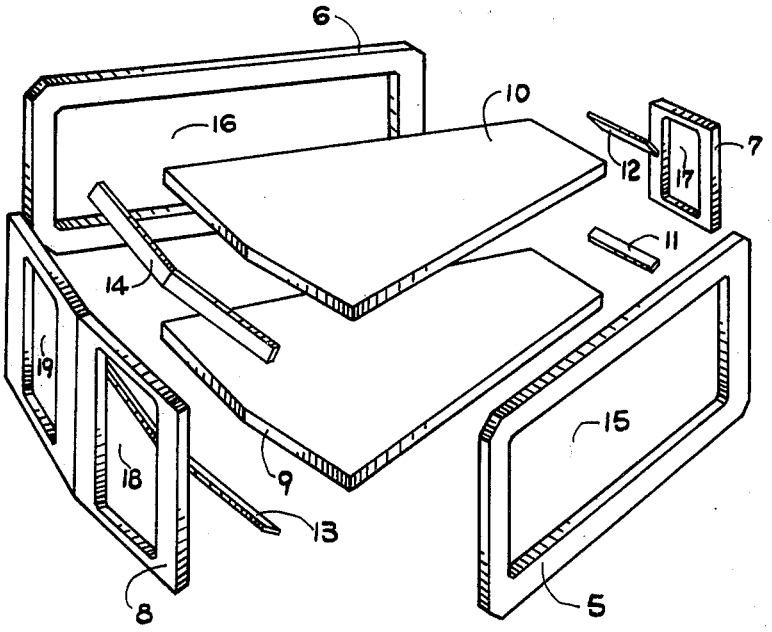
FIG. 2 is an exploded view of the separate sectional elements of the modular building segment.

The modular building segment further comprises FIG. 2, a floor section 9, and a congruent roof section 10, sector shaped to fit within the sector plan area formed by the two opposite rib-frames 5,6, and two opposing wall sections 7,8. Further comprising the modular building segment are four corner boards 11,12,13,14, which are placed at the open corners where walls 7,8 meet floor 9 and roof 10 sections. Rib-frames 5,6 each have a full width-height rectangular opening 15,16 within their respective rectangular rib-frame perimeters for expanding the modular building segment, and to receive various types of functional partitioning; straight wall section 7 contains one opening 17, and vee-shaped wall section 8 contains two openings 18,19, each sized for door access and other detachable fascade panels of various designs and functions.

All above components embodying the modular building segment, whose sector plan area corresponds approximately to that of the average bedroom-size room, are capable of efficiently utilizing standard construction techniques in the industrialized premanufacturing of them in portable, prefinished, individual sections, which systematically unite into the sector-like plan shaped modular building segment FIG. 3, by assembling the individual sections FIG. 2 in the following construction sequence; first the floor section 9 is set up in a horizontal position, followed vertically by the vee-shape wall section 8, which in relation, is set with its bottom end-face at right angle to the floor section's 9 corresponding end-face, so that inside corner edges of both end-faces line-up parallel and adjacent to one another. Then the straight wall section 7 is vertically set in the same manner with respect to the floor section 9. Next the roof section 10 is horizontally placed similarly with its respective end-faces at right angles to the top corresponding end-faces of the vee-shaped wall 8 and opposing straight wall 7 sections. The four corner boards 11, 12, 13, 14 are then set at a bias, between and along the outside corner edges of all right angle corner openings, which result from the foredescribed right angle, end-face meeting arrangement between floor 9 and walls 7,8, and roof 10 and walls 7,8, to form at each of the four corner meeting angles an open utilities trough accessible from the four detachable outside corner boards. The opposite two rib-frames 5,6 are then respectively set with their side face flush against all respective side end-faces of the two opposing wall sections 7,8, floor and roof sections 9,10, and the four corner boards 11,12,13,14, to externally protrude structurally, uniformly and continuously from the exterior surfaces of these components and structurally uniting same; which are joined together by suitable means of weathertight fastening, mechanically capable, after assembling into a rigid, highly transportable modular building segment FIG. 3, of easily disassembling back into same individual sections FIG. 2, for greater building flexibility. The two rib-frames 5,6 unite with the above components so that all four faces of each rib-frame's internal opening 15,16 are flush with all interior surfaces of floor 9, roof 10, and two opposing wall sections 7,8.

Figure 4:
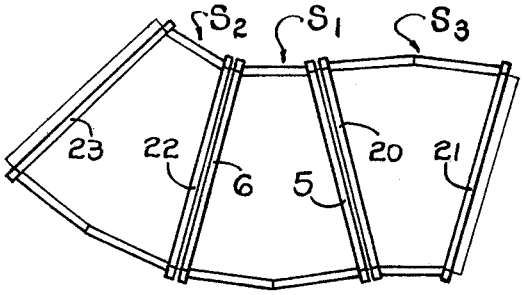
FIG. 4 is a top view of three horizontally conjoining modular building segments, interconnected between rib-frames to show two different plan-form relationships.

The two opposite and converging rib-frames 5,6 which are engineered by structural means to withstand loading along their respective, contiuously structural perimeter, bear and support all dead and live loads carried by the modular building segment's floor 9, roof 10, and two non-load bearing opposing wall sections 7,8, thereby making the modular building segment a self-supporting modular entity, structurally independent when placed in conjoining juxtaposition with congruent modular building segments FIG. 4. This independent structuring of the modular building segment via two opposite and identically shaped and sized rib-frames 5,6, each symmetrical and equal about their respective vertical and horizontal plane of symmetry, in conjunction with the two rib-frames' 5,6 converging plan-direction, permits the modular building segment to correlate and equally interconnect with either one of a congruent modular building segment's likewise identical two rib-frames in either one of two different plan-form relationships; one relationship being when one rib-frame 5 of the modular building segment's $S_1$ two identical rib-frames 5,6 is placed even and within parallel proximity to a rib-frame 20 of a congruent modular building segment's $S_3$ likewise identical two rib-frames 20,21, so that the narrow, converging sector end of each modular building segment $S_1$, $S_3$ is in the opposite direction and on opposite sides of each other; the second relationship being when one rib-frame 6 of a modular building segment's $S_1$ two identical rib-frames 5,6 is placed even and within parallel proximity to a rib-frame 22 of a congruent modular building segment's $S_2$ likewise identical two rib-frames 22,23, so that the narrow, converging sector end of each modular building segment $S_1$, $S_2$ is adjacent to, and on the same side of each other.

Figure 3:
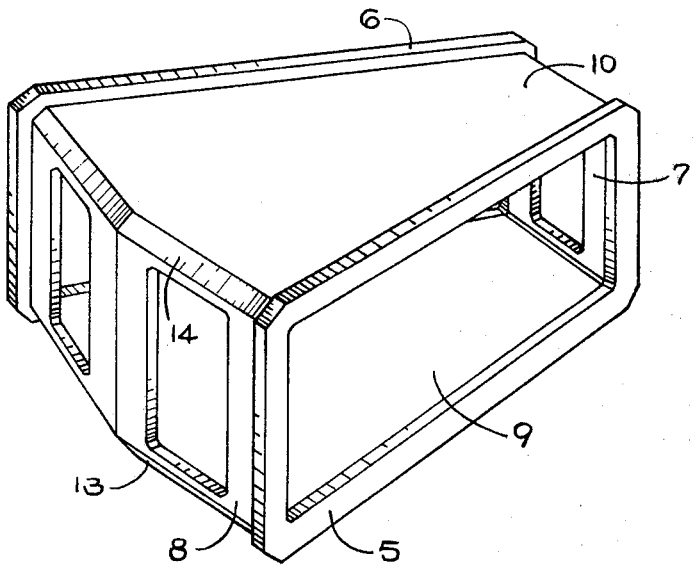
FIG. 3 is a perspective view of the assembled modular building segment.

To site-erect a building, a plurality of congruent modular building segments are transported to a prospective building site in either component form FIG. 2, for subsequent site-assembly into individual modular building segments, or in factory preassembled modular form FIG. 3 for immediate site-erection into the particular building configuration desired relative to the two optional and different foredescribed relationships herein possible between two congruent, conjoining modular building segments. Separate, serial implementation of these two relationships will produce from a plurality of the one modular building segment shape, two different basic building conformations FIG. 4; one, linear-like in plan-form, achieved by successive alternation $S_1$, $S_3$ of each modular building segment, so that their individual long center-axes are each parallel to one another; the other, curvilinear-like in plan-form, achieved by successive revolution $S_1$, $S_2$ of each modular building segment, so that their individual long center-axes are each converging and intersecting at a common point. Through optional combinations and varying degrees of these two basic building plan-form conformations, modular building segments capable of door access in each opposing wall, located respectively at the narrow and wide sector ends, can be juxtapositioned to produce on any type building site, a myriad of unique building plan, form, function, and size configurations; one of which being, when conjoining congruent modular building segments successively in complete revolution, a polygon-like building embodying a functional and accessible interior open court plan.

Figure 5:
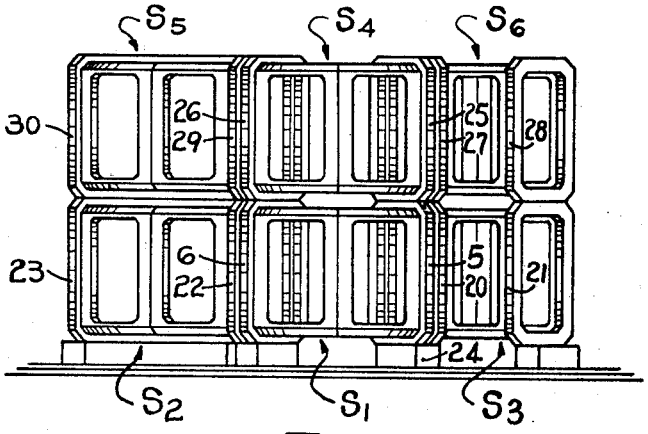
FIG. 5 is an elevation view of two story-levels of horizontally conjoining and vertically stacked congruent modular building segments, showing rib-frame alignment between story-levels.

Modular building segments by being individually self-supporting can easily be erected at any desired elevation above ground level FIG. 5 by suitable means of common foundation support member 24 and fastening between the ground and the structurally protruding bottom rails of mutual rib-frames 5,20 of conjoining modular building segments $S_1$, $S_3$, which are interconnected between same mutual rib-frames 5,20 by suitable means of weathertight joint closing and fastening, mechanically capable of subsequent disconnection and reconnection of conjoining modular building segments, so as to accommodate easy erection and removal of individually detachable modular building segments, for building maintenance and for altering a building's function, form, appearance, size, or setting, in part or whole, anytime during or after a building's completion.

To erect multistory buildings FIG. 5, modular building segments are first horizontally conjoined in the desired ground-level configuration, according to the foredescribed manner, and then individually stacked to the selected number of story-levels by vertically bearing, aligning, and fastening by suitable means, the structurally protruding rib-frames 25,26,27,28,29,30 of each upper modular building segment $S_4$, $S_6$, $S_5$, with and upon the structurally protruding and supporting rib-frames 5,6,20,21,22,23 of each corresponding lower conjoining modular building segment $S_1$, $S_3$, $s_2$. The novel feature of horizontally conjoining and vertically stacking modular building segments between their sturcturally protruding rib-frames intentionally establishes independent and separate floor and roof elements spaced between each story-level for the purpose of attenuating interstory sound transmissions, and additionally for whole or partial removal and addition of story-levels without alterations to the existing building.

To enclose each open rib-frame side 21,23 of each respective modular building segment $S_3$, $S_2$, terminating a building at each end, a typical FIG. 2 identical rib-frame section 5, apart from floor 9, roof 10, and two wall sections 7,8, is sealed within its normal rectangular opening 15, by suitable means of solid wall or window elements, and as such is interconnected, one each, to both open rib-frames 21,23, in the same manner of rib-frame interconnection as is normal between any two $S_1$, $S_3$ conjoining modular building segments.

After modular building segments are site-erected in the foregoing manner and suitable stairway access is provided, a building's interior can be made optionally multifunctional by maintaining normal rib-frame openings for contiguous full room expansion and by providing various types of demountable partitioning at the center parallel separation where all conjoining modular building segments $s_1$, $S_3$, $S_2$ interconnect between their mutually open rib-frames 5,20, and 6,22. Room sizes, types, and a building's particular function in whole or part will depend upon optional use and design of such center partitioning, and further upon the particular interior layout, equipment, and furnishings specifically incorporated into each modular building segment, and also upon, how such internally different modular building segments are optionally positioned to interrelate in plan with one another. Any and all such functional characteristics are alterable to any extent anytime during or after a building's completion by substitution of center partitioning and by exchanging specific modular building segments for modular building segments of a different internal design; further changes are possible by inserting functionally different door, window, or solid wall, detachable fascade panels, into modular building segments' exterior fascade openings 17,18,19, specifically designed for this purpose and additionally for the purpose of changing at anytime a building's exterior fascade design and appearance, which also can be more substantially changed by rearranging all or specific individual segments building sgements into a completely different overall building plan-form configuration.

The novelty of building by a plurality of specially structured congruent modular building segments, which feature in total a high frequency of redundant rib-frame, wall, floor, and roof sections, assures this invention low-cost, high-volume, mass-production utilization, through standard construction methods of sectional framing and sectional forming, in either wood, metal, concrete, or plastic materials, used either singularly of in any combination.

While the preferred embodiments of this invention have been described herein, it is to be understood that various elaborations and modifications can be made thereto without departing from the spirit and scope of this particular invention.

I claim:

1. A building structure comprising a plurality of congruent, sector-like modular building segments joined to each other in side to side relationship, each building segment comprising in combination, a. a roof sector and a vertically spaced congruent floor sector each having a first V-shaped end, a second narrower straight end and a pair of converging side edges extending between the first and second ends;

b. a V-shaped end wall extending between the V-shaped ends of the roof and floor sectors;

c. a straight end wall extending between the straight ends of the floor and roof sectors; and d. a pair of congruent opposing and converging rib-frames which join the roof, floor and end walls to form an independent self-supporting building segment, each rib-frame being symmetrical about both a vertical and horizontal axis so that frames of adjacent building segments may be joined to form portions of curved or linear building arrangements.

2. The building structure of claim 1 wherein the rib-frames protrude above and below the roof and floor sectors and to the outside of the end walls thus forming a supporting flange by which the building segments may be joined to each other and, or supported one above another over a foundation.

3. The building structure of claim 1 wherein the building segments may be dissassembled for transport to or from a building site.

4. The building structure of claim 1 wherein said straight and V-shaped end walls each contain one and two openings respectively to receive detachable fascade panels containing door, window, or other building elements.

5. The building structure of claim 1 wherein the end walls are provided with detachable corner boards along the top and bottom edges to form utilities troughs running continuously along the top and bottom of each end wall.

* * * * *